US006418917B1

(12) United States Patent
Bistue

(10) Patent No.: US 6,418,917 B1
(45) Date of Patent: Jul. 16, 2002

(54) CLOSED CRANKCASE BREATHER SYSTEM

(75) Inventor: Terry L. Bistue, Shelby Township, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/781,469

(22) Filed: Feb. 13, 2001

(51) Int. Cl.[7] ..... F01M 13/00
(52) U.S. Cl. ..... 123/572; 123/573
(58) Field of Search ..... 123/572, 573, 123/574

(56) References Cited

U.S. PATENT DOCUMENTS 4,269,607 A * 5/1981 Walker ..... 123/573
4,597,372 A * 7/1986 Furukawa ..... 123/572
4,768,493 A * 9/1988 Ohtaka et al. ..... 123/573
4,920,930 A * 5/1990 Sakano et al. ..... 123/572
5,329,913 A * 7/1994 Suzuki et al. ..... 123/573
5,487,371 A * 1/1996 Beckman et al. ..... 123/572

* cited by examiner

*Primary Examiner*—Marguerite McMahon
(74) *Attorney, Agent, or Firm*—Bill C. Panagos

(57) ABSTRACT

A separator (20) for a closed crank case ventilation system has an upstream located inlet (18) and downstream gas and oil outlets (30, 22). A plurality of flat plate baffles (58) alternately extend from opposing side walls to form a tortuous path for blow by gasses to separate the oil from the gasses. The separator (20) is located upstream from the crankcase depression regulator (34) such that the pressure differential between the separator and the crankcase (28) is minimal to allow the oil to easily open the check valve (26) and return to the crankcase.

3 Claims, 2 Drawing Sheets

CLOSED CRANKCASE BREATHER SYSTEM

TECHNICAL FIELD

The field of this invention relates to a closed crankcase ventilation system.

BACKGROUND OF THE DISCLOSURE

Government regulations relating to environmental concerns have mandated that many engines have a closed crankcase ventilation system. Commonly, these closed systems re-circulate any blow-by gases escaping from the combustion chambers and passing into the crankcase back into the air intake system. These blow-by gases, which are loaded with unburned gaseous hydrocarbons, are then re-circulated back to the intake manifold to be burned upon the next pass into the engine.

However, the crankcase gases are also usually loaded with oil droplets and moisture. The moisture condenses into water and drains from a crankvent breather. The oil that enters into the crankvent breather sits therein until normal maintenance when the breather is emptied and cleaned out. It has been known that a crankvent breather located below the rocker cover breather outlet allowed the breather canister to fill with engine oil due the downward angle of the hose leading from the outlet to the breather canister. As such, frequent maintenance was needed to empty the canister in order that it function properly.

Attempts have been made to relocate the crankvent breather to an upper intake area in the front of the engine above the rocker breather outlet. Testing showed that, as expected, the crankvent breather went a longer time before the oil filled the cannister. Vehicles fitted with the relocated breather run fine in the summer and in warm weather. However, during cold weather months, an oil emulsion was found in the oil breather cannister with the drain check valve frozen shut. With the drain blocked, the water and emulsion solidified and plugged the breather system well before the scheduled maintenance. The plugged breather system creates high crankcase pressure in the engine. The high crank pressure in the engine may push oil past the turbocharger seals and into the intake air, causing exhaust smoke.

What is needed is an expeditiously constructed crankcase ventilation system that prevents excessive oil buildup within the breather canister but can also work during cold weather.

SUMMARY OF THE DISCLOSURE

In accordance with one aspect of the invention, a closed crankcase breather system for an internal combustion engine includes a crankvent breather with an inlet, gas outlet and water drain outlet. The crankvent breather is operably interposed between a rocker cover breather outlet and a hose leading to an intake system. The crankvent breather is located in proximity to the engine for receiving heat from the engine. Preferably, the crankvent breather is located in proximity to a rear end of the engine block and below the rocker cover breather outlet.

An inlet hose is connected to the crankvent breather inlet and in communication with the rocker cover breather outlet. An oil accumulator is in line between the rocker cover breather outlet and the inlet hose. The oil accumulator is constructed for separating oil from the exhaust gasses exiting the rocker cover breather outlet and returning the oil through the rocker cover breather outlet into said rocker cover, but allowing the exhaust gasses to pass to the crankvent breather.

Preferably, the oil accumulator and the inlet hose leading to the crankvent breather are covered by a heat insulating material to prevent the moisture in the exhaust gasses from freezing before draining from the crankvent breather. Preferably this heat insulating material is a mylar insulation material.

In accordance with another aspect of the invention, an oil accumulator for a closed crankcase ventilation system has a lower inlet connectable to a rocker breather outlet, an upright cylindrical body with a substantially flat top wall and an upper outlet spaced from downwardly from the top wall. Preferably, the lower inlet and the upper outlet are circumferentially spaced at right angles from each other about the cylindrical body. Both the inlet and outlet have a respective longitudinal axis intersecting the longitudinal axis of the cylindrical body. Preferably, a mounting flange extends from the cylindrical body. The flange is substantially planar with the top wall.

In this fashion, a closed crankcase system with a breather is provided which fills with oil more slowly and thus can have less frequent maintenance checks. The system works during cold weather conditions and prevents freezing of the moisture which may otherwise block the operation of the breather. The system works under adverse situations where a cylinder kit fails and causes significant blow by of oil and blow by gasses pass into the crankcase. In this way, the air intake system and turbo charge system are more adequately protected when a cylinder kit failure occurs.

BRIEF DESCRIPTION OF THE DRAWINGS

Reference now is made to the accompanying drawings in which.

DETAILED DESCRIPTION OF THE PREFERRED EMBODIMENT

Figure 1:
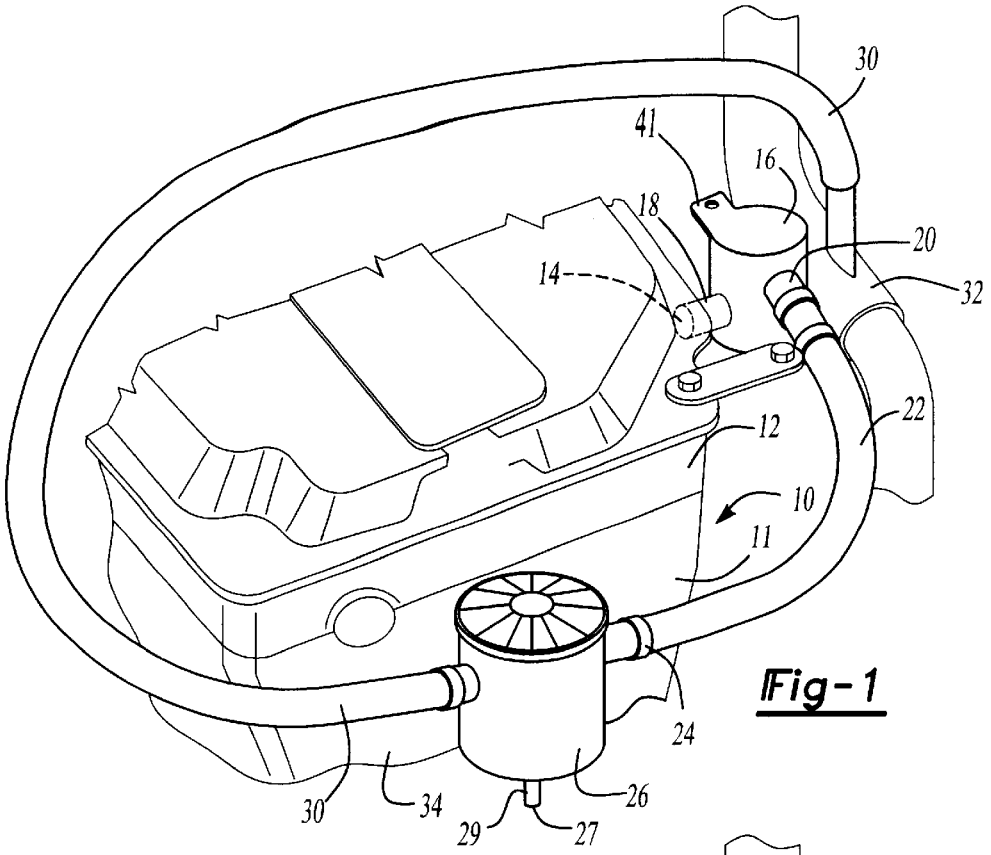
FIG. 1 is a perspective and fragmentary view of an engine which uses a closed crankcase system in accordance with one embodiment of the invention with the insulation removed to further illustrate the location of the oil accumulator.
Figure 2:
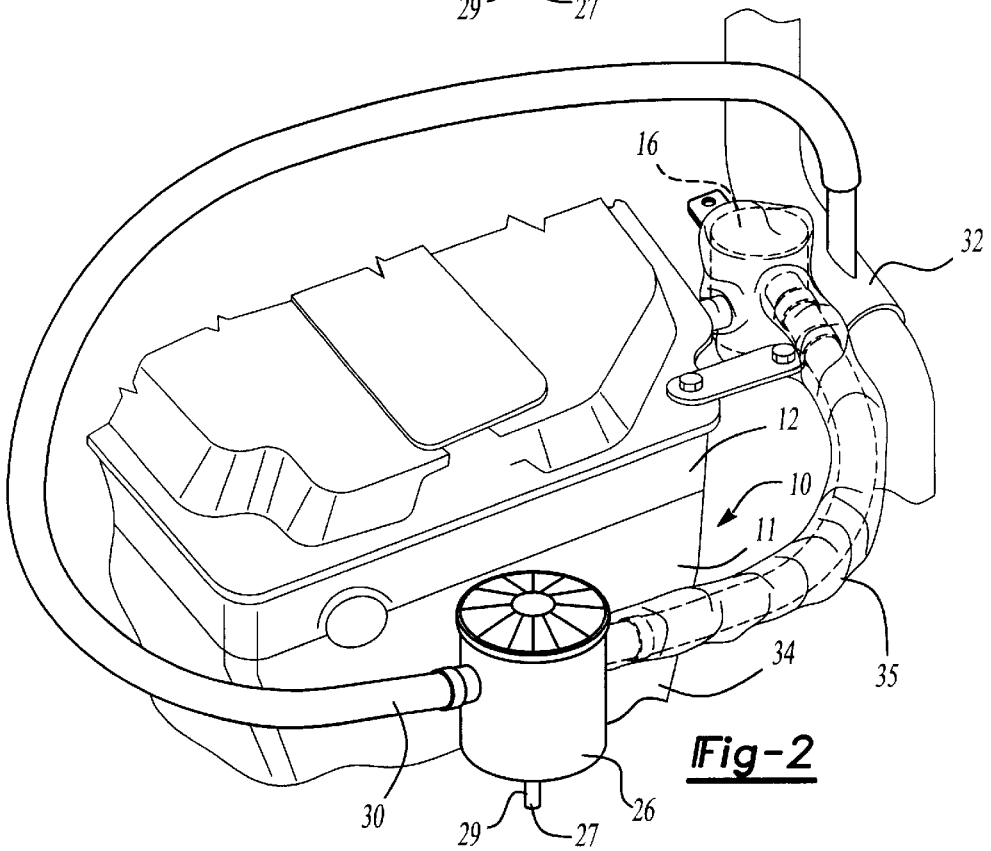
FIG. 2 is a view similar to FIG. 1 illustrating the heat insulation material wrapped about the oil accumulator and the inlet hosing.

Referring now to FIG. 1, an engine 10 has an engine block 11 with rocker cover 12 placed thereon. The rocker cover has an outlet 14. The outlet 14 is connected to an inlet 18 of an oil accumulator 16. The oil accumulator also has an outlet 20 connected to a inlet hose 22 that has its downstream end 24 connected to a conventionally constructed crankvent breather 26. The conventionally constructed breather 26 is filled with filter material to help oil and water to condense out of the exhaust gasses passing through the breather. The breather 26 has a conventional water drain (not shown) with a conventional check valve (also not shown for simplicity of the drawings) to prevent dirt from passing into the breather. The breather also has a has an outlet 28 connected to a outlet hose 30 that has its downstream end connected to the turbocharger intake 32. The breather 26 is positioned in proximity to the rear end 34 of the engine 10 to be warmed by the ambient heat emanating from the engine when it is operating. The breather 26 is situated at a height below the rocker cover breather outlet 14 so that it is directly adjacent the engine block 11 to promote sufficient ambient heat exchange to the breather 26. In addition to the placement of the breather 26 in proximity to the engine block, the outlet 14, accumulator 16 and inlet hose 22 is wrapped with mylar insulation 35 to maintain the heat of the exhaust gasses after they leave the rocker cover outlet until they pass into the breather 26.

Figure 3:
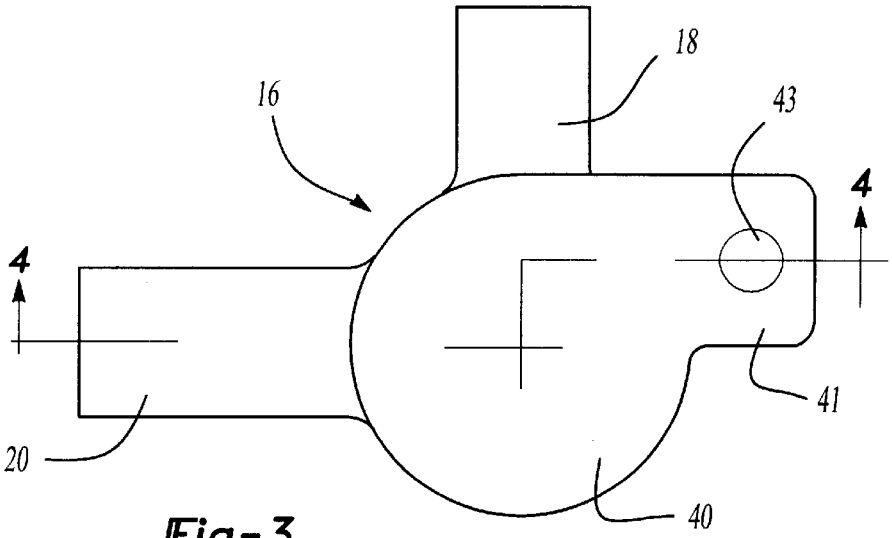
FIG. 3 is a top plan view of the oil accumulator shown in FIG. 1.
Figure 4:
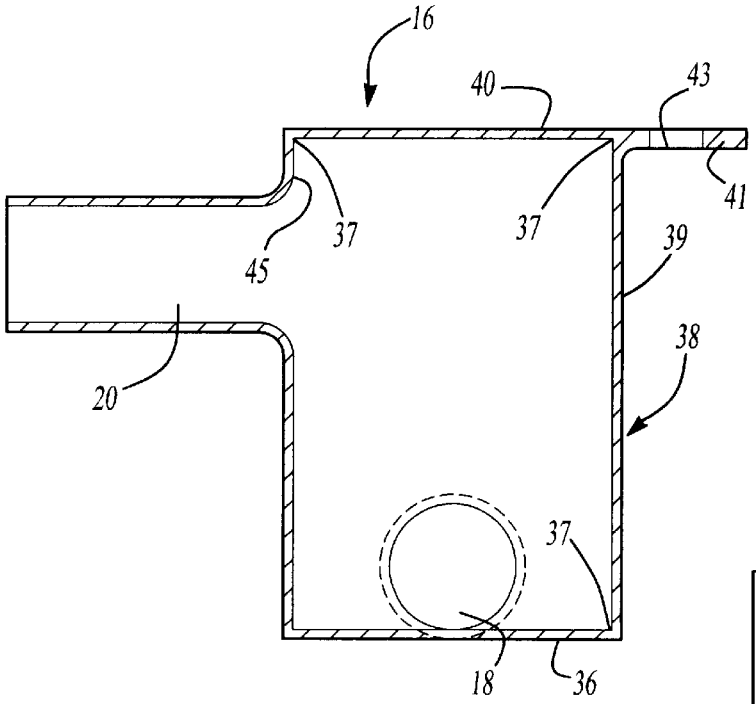
FIG. 4 is a cross-sectional view of the oil accumulator taken along the lines 4—4 shown in FIG. 3.
Figure 5:
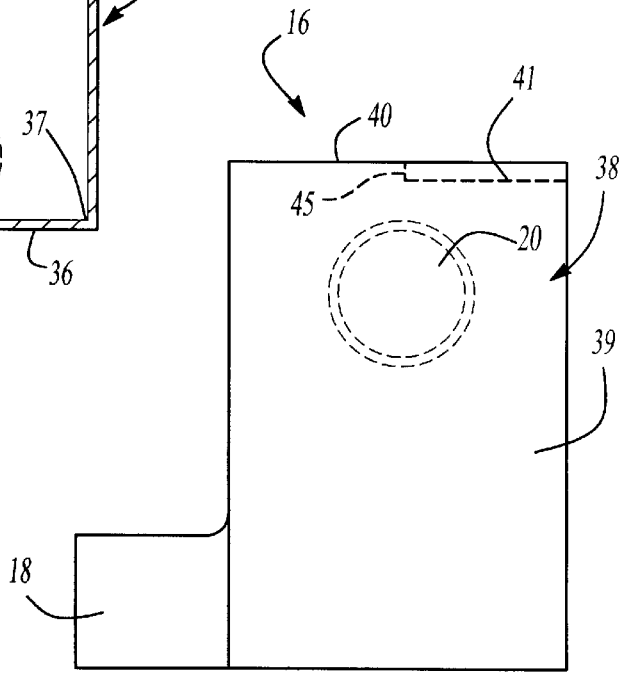
FIG. 5 is a side elevational view of the oil accumulator shown in FIG. 1.

The accumulator 16, as illustrated in FIG. 3–5, has its inlet 18 in proximity to a lower floor 36 of an upright cylindrical body 38. The cylindrical body has a side wall 39 and an upper flat top 40. A mounting flange 41 with a mounting aperture 43 is coplanar with the flat top 40. The mounting flange and aperture provide for affixing the accumulator to a fixed support (not shown) within the engine compartment (not shown).

The outlet 20 is spaced from the upper flat top 40. The outlet 20 also is circumferentially spaced from the inlet 18 to form a right angle therebetween. The longitudinal axis of the inlet and outlet intersect the longitudinal axis of the upright cylindrical body 38. The flat floor 36 and flat top 40 form a relatively sharp edge 37 with the cylindrical wall 39. The inlet 18 is spaced from the top 40 and the sharp edge 37 to provide a turbulence enhancing The structural combination of the sharp edges 37, vertical height differences of the outlet from the inlet and from the top 40, and the circumferential spacing of the inlet 18 from the outlet 20 provide for sufficient turbulence within the cylindrical body to have significant amount of oil droplets drop out of the blow by gasses passing into the accumulator. The oil then backs out of the accumulator back to the engine 10.

The blow-by gasses, then stripped of a significant amount of oil, pass through the inlet hose and to the breather 26. The breather provides for the draining of the water from the blow-by gasses. The water is prevented from freezing due to the heat of the exhaust gas maintaining enough warmth due to the insulating properties of the mylar wrap 35 and the proximity of the breather 26 to the hot engine.

In this fashion, this system provides for a long lasting breather that has longer maintenance intervals and eliminates virtually all freeze related blockage. The oil is easily returned to the engine crankcase through the rocker cover outlet thereby preventing any blocked conditions. Furthermore, the accumulator is expeditiously constructed with a cylindrical shape and a tubular inlet and outlet.

Variations and modifications are possible without departing from the scope and spirit of the present invention as defined by the appended claims.

The embodiments in which an exclusive property or privilege is claimed are defined as follows:

1. A closed crankcase breather system for an internal combustion engine comprising:

a crankvent breather with an inlet, gas outlet and water drain outlet; said crankvent breather operably interposed between a rocker cover breather outlet and a hose leading to an intake system;

said crankvent breather located in proximity to a rear end of the engine for receiving heat from said engine;

an inlet hose connected to the crankvent inlet and in communication with the rocker cover breather outlet; said crankvent breather further located below said rocker cover breather unit;

an oil accumulator in line between the rocker cover breather outlet and the inlet hose, said oil accumulator constructed for separating oil from said crankcase gasses exiting said rocker cover breather outlet and returning said oil through said rocker cover breather outlet into said rocker cover; said oil accumulator having a lower inlet connected to said rocker breather outlet, an upright cylindrical body with a substantially flat top wall and an upper outlet spaced downwardly from said top wall; said oil accumulator and said inlet hose leading to said crankvent breather being covered by a heat insulating material; said lower inlet and said upper inlet being circumferentially spaced at right angles from each other about the cylindrical body and both inlet and outlet have respective longitudinal axis intersecting the longitudinal axis intersecting the longitudinal axis of the cylindrical body; and a mounting flange extending from said cylindrical body substantially planar wit said top wall.

2. A closed crankcase breather system as defined in claim 1 further characterized by:

said lower inlet and said upper outlet being circumferentially spaced at right angles from each other about the cylindrical body and both inlet and outlet having a respective longitudinal axis intersecting the longitudinal axis of said cylindrical body;

a mounting flange extends from said cylindrical body substantially planar with said top wall.

3. An oil accumulator for a closed crankcase breather system characterized by:

a lower inlet connectable to a rocker breather outlet, an upright cylindrical body with a substantially flat top wall and an upper outlet spaced downwardly from said top wall and being connectable to a breather inlet hose.

* * * * *